United States Patent [19]

Addington

[11] 3,940,012

[45] Feb. 24, 1976

[54] SPLASH GUARD FOR CUPS

[76] Inventor: Bruce N. Addington, 1402 Grant Ave., Boise, Idaho 83706

[22] Filed: Jan. 3, 1975

[21] Appl. No.: 538,501

[52] U.S. Cl. ..... 220/90.4; 215/100 R

[51] Int. Cl.[2] ..... A47G 19/22

[58] Field of Search ..... 220/90.4, 90.2, 90.6; 215/100 R, 100.5, 101

[56] References Cited

UNITED STATES PATENTS

| | | | |
|---|---|---|---|
| 535,691 | 3/1895 | Frampton | 220/90.2 |
| 2,278,586 | 4/1942 | Potter | 220/90.4 |
| 3,549,044 | 12/1970 | Lerner | 220/90.4 |

FOREIGN PATENTS OR APPLICATIONS

| | | | |
|---|---|---|---|
| 630,925 | 10/1949 | United Kingdom | 220/90.4 |

*Primary Examiner*—George E. Lowrance
*Assistant Examiner*—Steven M. Pollard
*Attorney, Agent, or Firm*—John W. Kraft; Charles L. Kraft, II

[57] ABSTRACT

The splash guard for cups comprises a pedestal having an openwork base and a pedestal issuing upstandingly from the base, and an openwork lattice which is fabricated of buoyant material and which is slidably mounted by a sleeve on the pedestal post.

3 Claims, 3 Drawing Figures

SPLASH GUARD FOR CUPS

FIELD OF INVENTION

The present invention relates to splash guards for cups.

DESCRIPTION OF THE PRIOR ART

A great number of anti-spill devices for drinking containers have been offered to remedy the notorious sloshing and spilling of liquids carried in glasses, cups and the like. Generally, these have comprised various constructions of vertically opened lattices which are fabricated of materials which float on the surface of the liquid. It has been found that the freely floating splash guard may be unstable during filling of the container, and may interfere with drinking. Accordingly, devices of the prior art have been modified to ride closely within the interior walls of the container. However, this results in limited success since many containers vary in size, both with respect to other containers and between various portions of the container itself. Thus, splash guards for drinking containers have had limited acceptance.

Accordingly, it is an object of the present invention to provide a splash guard for cups which, by a limited number of sizes, may accommodate a wide variety of container diameters and configurations.

It is a further object of this invention that the present splash guard be of simple, durable and hygienic construction.

These and other objects shall become apparent from the description following, it being understood that modifications may be made without affecting the teachings of the invention here set out.

SUMMARY OF THE INVENTION

The splash guard for cups comprises a pedestal having an openwork base and a pedestal issuing upstandingly from the base, and an openwork lattice which is fabricated of buoyant material and which is slidably mounted by a sleeve on the pedestal post.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
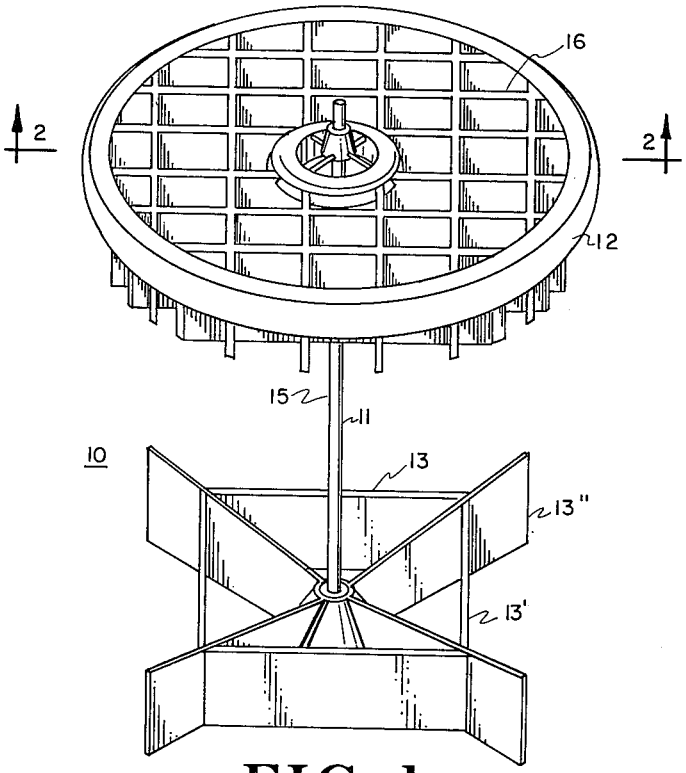
FIG. 1 is a top perspective view of the splash guard for cups of this invention.

Referring now to the drawings, and more particularly to the FIG. 1, the splash guard for cups of this invention is shown to advantage and generally identified by the numeral 10. The splash guard 10 comprises a pedestal 11 and a lattice 12.

Figure 2:
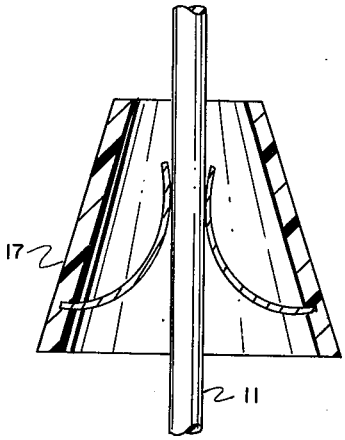
FIG. 2 is a fragmentary cross-sectional view taken substantially along the lines 2—2 of the FIG. 1.
Figure 3:
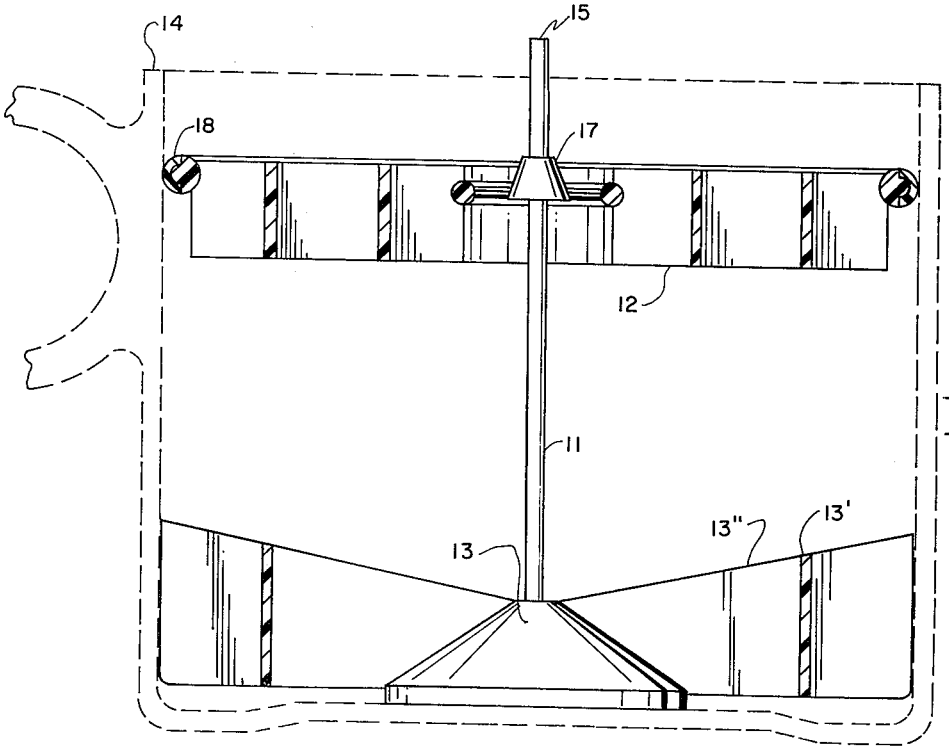
FIG. 3 is a cross-sectional view of the present splash guard as it would appear in a cup which is also in cross section in broken lines for illustrative purposes.

The pedestal 11 comprises a horizontally disposed base 13 which is operable to rest on the bottom of a container such as a cup 14 shown in the FIG. 3. It is intended that the base 13 be an openwork to permit the greatest amount of liquid poured into the cup 14. The base 13 may comprise an openwork of a pair of vertically disposed, perpendicularly crossed strips 13′ secured in this juxtaposition by a rectangle of diagonal strips 13″ fastened at terminal ends of the strips 13′. An upstanding post 15 issues upwardly from the inner section of the webs. It has been found to advantage to fabricate the pedestal 11 of a material which will remain submerged, rather than buoyant, in the fluid. It may also be of advantage to fabricate the base 14 with dimensions substantially the same as the interior dimension of the bottom of the cup to provide stability. The post 15 may project above the uppermost edge of the cup 14 to provide a convenience point for grasping the guard 10. The lattice 12 comprises a multiplicity of perpendicularly intersecting, distally disposed strips 16. A sleeve 17 is disposed centrally in the lattice 12, and rides about the post 15. As shown more clearly in the FIG. 2, the sleeve 17 may be a hollow, cone-shaped member disposed with its narrower end upwardly with respect to the post 15. A pair of leaf-spring-like strips are disposed on the interior side of the sleeve 17 to loosely frictionally ride about the exterior of the sleeve 17. A perimeter ring 18, which may have substantially the same configuration and size as the interior dimension of the cup 14, is disposed about the perimeter of the lattice. The ring 18 is intended to be a hard polymeric member to facilitate movement of the lattice 12 along the walls of the cup 14.

As shown more clearly in the FIG. 3, in operation, when liquid is poured into the cup 14 having the splash guard 10, the lattice 12 being more buoyant than the fluid will tend to rise in the cup 14 along the post 15. As fluid is decanted from the cup 14, the lattice 12 will tend to fall along the post 15. The guard 10 may also be lifted by the pedestal 11.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. A splash guard for cups, comprising:

a pedestal having an outwardly, horizontally projecting base and on upstanding post issuing centrally from said base; and a vertically disposed openwork having a centrally disposed, vertically oriented sleeve operable to slide over said post, said sleeve being provided on its interior side with a pair of leaf-spring members which ride over the exterior of said post.

2. The article of claim 1 wherein said openwork is provided with a perimeter cushion.

3. The article of claim 1 wherein said base of said pedestal is an openwork construction of vertically disposed, cross strips.

* * * * *